US006170759B1

(12) United States Patent
Meyer

(10) Patent No.: US 6,170,759 B1
(45) Date of Patent: Jan. 9, 2001

(54) METHOD AND DEVICE FOR APPLYING AN ADHESIVE TO A PRODUCT SURFACE

(75) Inventor: Thomas Meyer, Haemikon (CH)

(73) Assignee: Robatech AG, Muri (CH)

( * ) Notice: Under 35 U.S.C. 154(b), the term of this patent shall be extended for 0 days.

(21) Appl. No.: 09/386,229

(22) Filed: Aug. 31, 1999

(30) Foreign Application Priority Data

Sep. 4, 1998 (CH) ..... 1815/98

(51) Int. Cl.[7] ..... B05B 1/28; B05B 7/02

(52) U.S. Cl. ..... 239/298; 239/300; 239/412; 239/417.3; 239/424

(58) Field of Search ..... 239/290, 292, 239/298, 300, 412, 417, 417.3, 417.5, 418, 420, 424, 424.5

(56) References Cited

U.S. PATENT DOCUMENTS

Re. 33,481 12/1990 Ziecker et al. .
4,969,602 11/1990 Scholl .
5,065,943 11/1991 Boger et al. .
5,431,343 * 7/1995 Kubiak et al. ..... 239/424 X

FOREIGN PATENT DOCUMENTS 9404282 3/1994 (WO) .

* cited by examiner

*Primary Examiner*—Lesley D. Morris
(74) *Attorney, Agent, or Firm*—Browdy & Neimark

(57) ABSTRACT

The invention relates to a method and a device for the delivery of adhesives, in particular for the delivery of hot melt adhesives in the form of a thin stream of adhesive spray directed onto the product surface and acted upon by at least one air jet. A spray head (40) is arranged at the one end of the device (45), which comprises a connecting housing (25) for receiving a insertion element (30), provided with an outlet opening (34) for the thin stream of adhesive spray (glue) and embodied as a nozzle conduit, a guide sleeve (35), designed for the coaxial seating of the piston rod (43), as well as a nozzle body (15) with bores (20) arranged in the circumferential direction distributed in respect to each other, in which an air nozzle (10) with an interior chamber, which is embodied to be convergent-divergent in the flow-through direction, is respectively arranged.

26 Claims, 3 Drawing Sheets

METHOD AND DEVICE FOR APPLYING AN ADHESIVE TO A PRODUCT SURFACE

FIELD OF THE INVENTION

The invention relates to a method for applying an adhesive to a product surface wherein, by means of a spray head provided with a nozzle body, the adhesive is applied to the product surface to be sprayed as a thin stream of spray in the approximate shape of a spiral, on which at least one air jet acts at the outlet. The invention also relates to a device for executing this method.

BACKGROUND OF THE INVENTION

An arrangement for applying an adhesive to a product surface is known from U.S. Pat. No. 5,065,943, which essentially comprises a spray apparatus and a preparation device for the adhesive functionally connected therewith, as well as an air injection device, which is connected via at least one conduit with a spray head, wherein either a nozzle body, which is embodied in the shape of a disk and fastened by a screw-on cap on the latter, or a cap embodied as a nozzle body, are arranged on the spray head. The nozzle body, which is penetrated by an outlet opening, is provided with several bores, which are distributed in the circumferential direction and are oriented parallel in respect to a frustoconical tip and obliquely in the direction of the exiting thin stream of spray, from each of which an air jet is directed against the exiting thin stream of adhesive spray and the latter is applied in the approximate shape of a spiral to the product surface to be sprayed.

Further, similar arrangements with appropriately embodied spray devices for the spiral-shaped application of a thin stream of adhesive spray to a product surface are known from U.S. Pat. No. 4,969,602, U.S. Re-issued Pat. No. 33,481 and International Patent Publication WO 94/04282, in which the spray head is respectively provided with a nozzle body, which is embodied in the shape of a disk and held by a screw-on cap or the like.

The individual elements of the spray device of the known arrangements, in particular those of the spray head, have a relatively complicated structural design, wherein the nozzle body respectively arranged on and fastened to the spray head and the bores arranged therein has respective production tolerances, which cause an uneven spiral application, and in addition require a fresh time- and cost-consuming readjustment after the nozzle body has been changed.

OBJECT AND SUMMARY OF THE INVENTION

The invention is based on the object of creating a method, as well as a device with a spray head and nozzle body arranged thereon, by means of which a guidance of the adhesive jet can be achieved, which is even and laterally exactly limited in relation to the respective application surface to be sprayed.

Regarding the method, this object is attained in that, for the spiral-shaped delivery and application on the product surface, the thin stream of adhesive spray exiting the spray head is acted upon by at least one air jet, which is accelerated by means of convergent-divergent means of the nozzle body.

The device for executing the method is distinguished in that for obtaining an air jet which exits in an accelerated manner and is directed onto the thin stream of adhesive spray, an air nozzle with an interior chamber which is designed to be convergent-divergent in the flow-through direction, can be respectively inserted into bores of the nozzle body, which bores are charged with air via an associated air conduit, or that the interior chamber of the single bore, which is oriented in the flow-through direction, is designed to be convergent-divergent.

Further characteristics of the invention ensue from the following description in connection with the individual claims and the drawings.

The invention will be described in what follows in connection with the exemplary embodiments represented in the drawings.

DETAILED DESCRIPTION OF THE PREFERRED EMBODIMENTS

Figure 1:
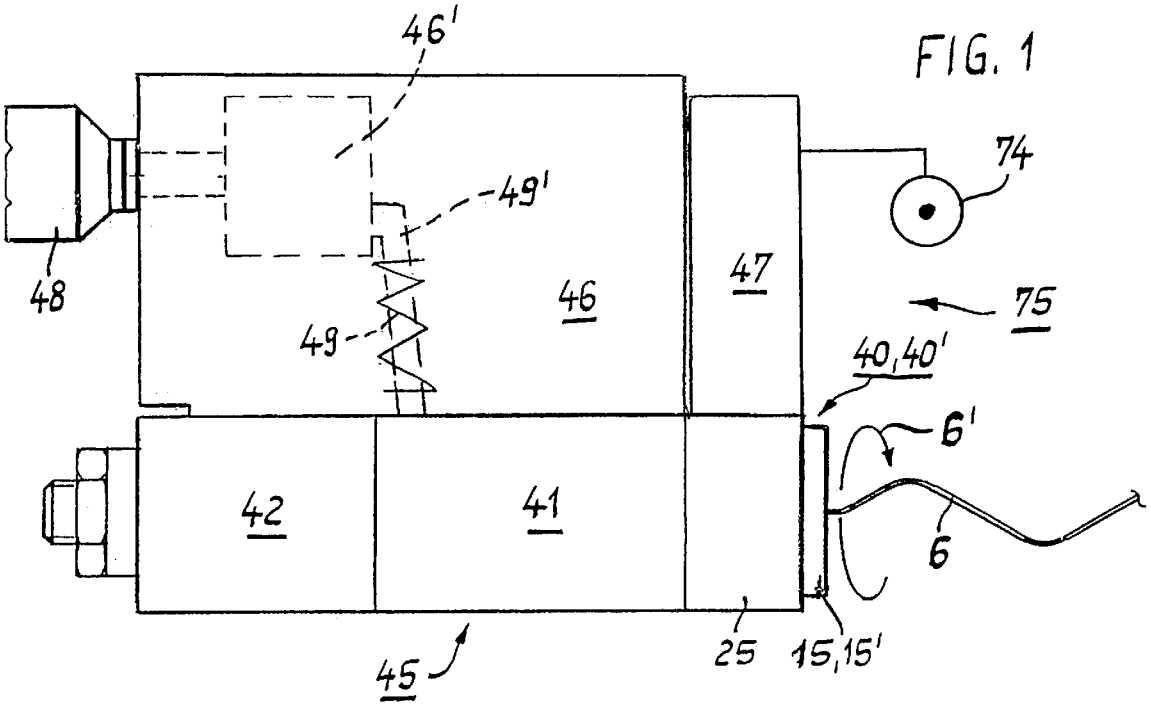
FIG. 1 represents an installation, shown in a schematic plan view, for the delivery and application of an adhesive in the form of a thin stream of spray to a product surface.

FIG. 1 represents an installation 75 for the delivery of adhesives, in particular a hot melt adhesive in the form of a so-called thin stream of spray 6, shown in a schematic plan view. By means of a spray head 40 or 40' arranged in the installation 75, the thin stream of spray 6 is acted upon by at least one air jet in the area of an outlet opening, not represented in FIG. 1, and as a result is applied in accordance with the arrow direction 6' in the approximate shape of a spiral on a product surface, not represented, which is to be sprayed with the adhesive.

The installation 75 essentially comprises a spray device 45 with the spray head 40 or 40' arranged on the one end, as well as a preparation device 46 and an air injection device 47, which is connected with a compressed air source 74. The two devices 46 and 47 together with the functional elements arranged therein, can also be arranged together in a one-piece housing. The preparation device 46 is connected via a hose 48, which is heated by suitable means with a reservoir, not represented, and a pump arranged therein. The adhesive is appropriately liquefied in the reservoir and is supplied through the heated hose 48 to the preparation device 46, and from there is conducted via a filter 46' and a conduit 49' connected with it to the spray device 45. The conduit 49' is preferably provided with a heating element 49, schematically represented in FIG. 1, for maintaining a constant temperature of the glue or adhesive.

The spray head 40 or 40' arranged on the front end of the spray device 45 can be charged with compressed air from the air injection device 47, which is connected with the compressed air source 74. The two devices 46 and 47, which are functionally connected with the spray device 45, are sealed against each other by appropriately assigned seals in the conduits which are connected with each other in a manner not represented, and are fastened on each other by means of screw connections, also not represented. Together, the elements 40 or 40', 45, 46 and 47 constitute the installation 75 embodied as a component (FIG. 1).

In the exemplary embodiment shown, the spray device 45 schematically represented in FIG. 1 comprises two housings 41 and 42, which are connected with each other, as well as the spray head 40 or 40', arranged on the front end of the first housing 41. The spray head 40 or 40' has a connecting housing 25, which is connected with the air injection device 47, as well as a nozzle body 15 or 15', arranged and fastened on the housing 25. The individual elements of the spray head 40 or 40' in accordance with the invention will be described in detail in what follows in connection with FIGS. 2 to 8.

Figure 2:
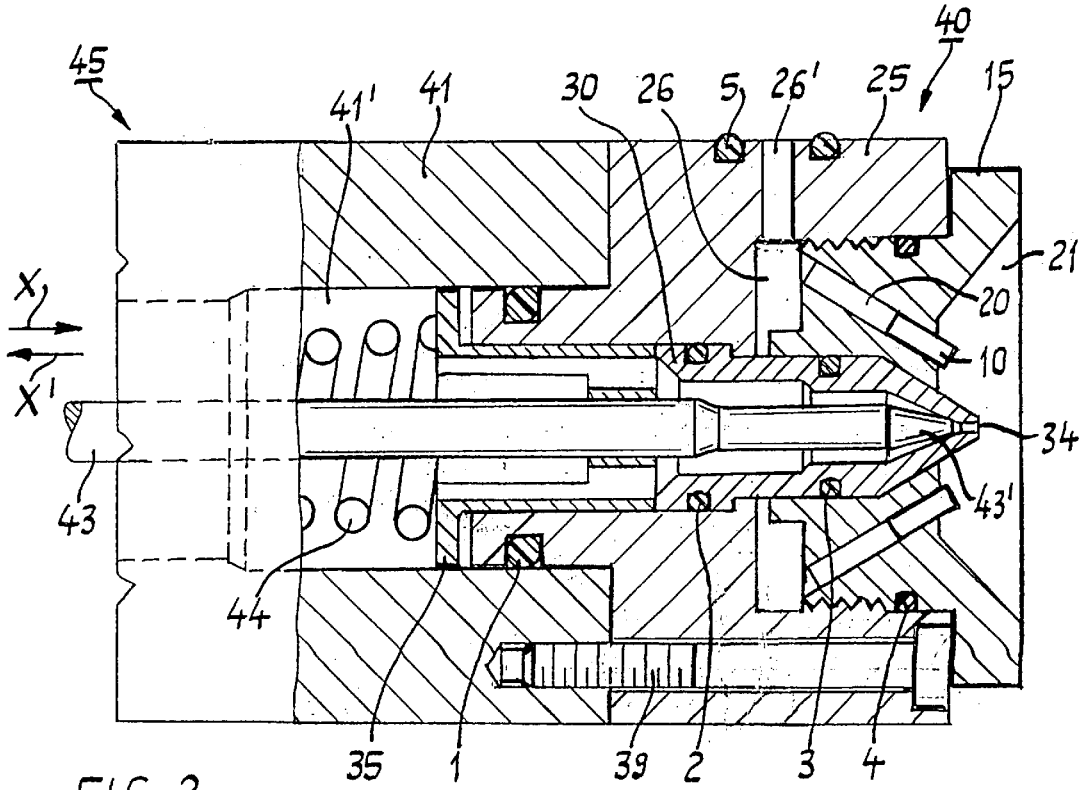
FIG. 2 represents a first exemplary embodiment, shown on a larger scale and partially in section, of a spray head for a spray device which is connected with the installation in accordance with FIG. 1.
Figure 3:
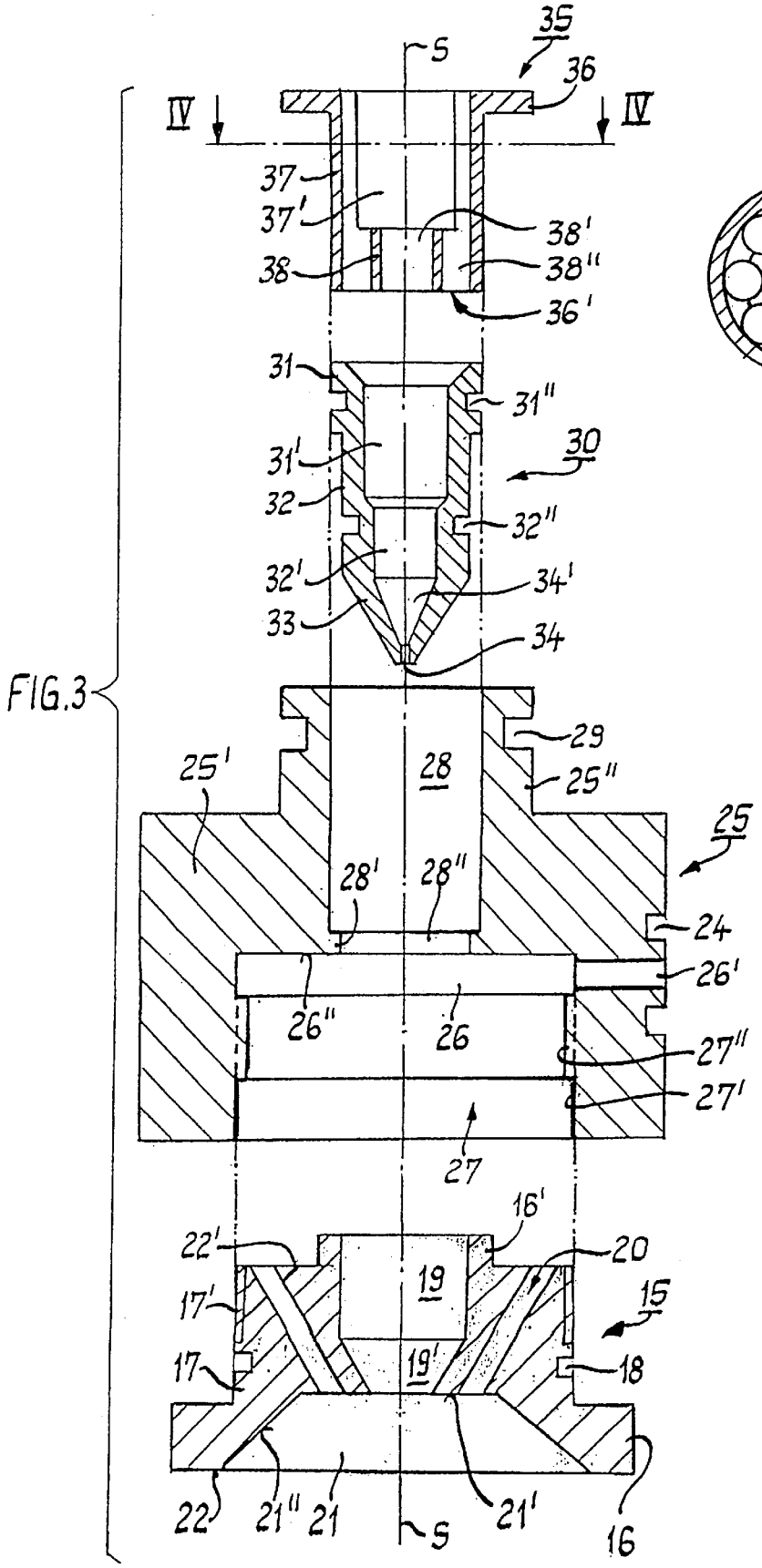
FIG. 3 represents the individual elements of the spray head in accordance with FIG. 2, shown in the disassembled state.

The spray head 40, together with the connecting housing 25 and the nozzle body 15, arranged on the partially represented first housing 41 of the spray device 45, is shown on an enlarged scale and in section. The connecting housing 25 is fastened by means of several screws 39 (only shown once), which are arranged distributed in the circumferential direction in relation to each other, on the first housing 41 of the spray device 45, represented partially in section. Furthermore, an insertion element 30, a guide sleeve 35 with an associated compression spring 44, which is in functional connection with the latter, as well as a piston rod 43 can be seen in FIG. 2. On its one end, the piston rod 43 is functionally connected with at least one piston element, not represented, and is coaxially arranged in the interior chamber 41' of the first housing 41, as well as in the individual elements 35 and 30 of the spray head 40. Depending on the pressure charge on the piston element, or respectively the position elements, the piston rod 43, which is functionally connected therewith in a manner not represented, can be displaced in accordance with the arrow direction X or X' (FIG. 2). On the other, the front end, the piston rod 43 is provided with a partial element 43', designed to be tapering conically, and is arranged in the insertion element 30, which is provided with a correspondingly conically tapering recess 43' (FIG. 3). For the ejection in the form of the thin stream of adhesive spray 6 (FIG. 1), which is delivered under pressure by means of the not represented piston elements, the insertion element 30 is provided with an appropriately embodied outlet opening 34.

In connection with a variation, not represented, of the piston rod 43, a needle-shaped tip can be arranged at the front end of the conically tapering partial element 43', which can be inserted into the outlet opening 43 of the insertion element 30 to close it. The tip 43" (FIG. 7) projects out of the outlet opening 34 by approximately 0.2 mm, so that in this operating position there is no remaining amount of adhesive in the outlet opening 34 embodied as a nozzle conduit. By means of this the formation of drops (glue spots), which leads to malfunctioning of the machine, is prevented at the start of the glue application on the product surface to be sprayed.

As represented in FIG. 2, the connecting housing 25 is arranged with a seal 1 in the interior chamber 41' of the first housing 41, the insertion element 30 with a seal 2 in the connecting housing 25, as well as with a seal 3 in the nozzle body 15, and the latter with a seal 4 in the connecting housing 25. The connecting housing 25 is connected with the air injection device 47 via an inlet bore 26' arranged on it having the associated seal 5. The air injection device 47 is fastened on the connecting housing 25 by means of a screw connection, not represented. Also visible in FIG. 2 is the nozzle body 15, which is provided with a recess 21, as well as with bores 20 distributed in the circumferential direction in relation to each other. Respectively one air nozzle 10 is arranged in the individual bores 20 and held in place by means not represented.

The individual elements 15, 25, 30 and 35 of the spray head 40 in accordance with FIG. 2 are represented in FIG. 3 in the direction of their common axis of symmetry S in the disassembled state as a so-called exploded representation. The elements 15, 25, 30 and 35 will be described in what follows.

The nozzle body 15 has a cylindrical partial element 17, which is provided on one end with a flange 16 formed on it, and on the other end with a shoulder 16' formed on it. An annular groove 18 for the seal 4 (FIG. 2), as well as an exterior thread 17' extending up to the rear 22', are arranged on the exterior circumference of the cylindrical partial element 17. On the front 22, the nozzle body 15 is provided with the recess 21 which has, starting at the front 22, a conically tapering lateral wall 21" in the direction toward an interior wall 21'. The nozzle body 15 furthermore is provided with a first cylindrical bore 19 and, adjoining it, a second bore 19', which is conically tapered in the direction toward the interior wall 21' of the recess 21. The two bores 19 and 19', which penetrate the nozzle body 15 in the axial direction are designed for coaxially receiving the insertion element 30, as represented in FIG. 2. Several bores 20 are provided on the circularly-shaped back 22' of the cylindrical partial element 17, which are distributed in the circumferential direction and are arranged at distances from each other and penetrate, inclined in the direction of the axis of symmetry S, the cylindrical partial element 17 of the nozzle body 15 starting at the back 22'.

In the exemplary embodiment represented in FIG. 3, the bores 20 of the nozzle body 15, which are oriented obliquely in the direction of the axis of symmetry S, are embodied for the insertion of a correspondingly designed air nozzle 10 (FIG. 2). The single air nozzle 10 can be adjusted in the respective bore 20 in its axial direction in respect to the interior wall 21' of the recess 21 of the nozzle body 15. The particular design of the air nozzle 10 will be described in what follows in connection with FIG. 5.

The connecting housing 25 has a first cylindrical partial element 25', as well as a second cylindrical partial element 25", designed set off in respect to the latter and with an annular groove 29 for the seal 1 (FIG. 2) arranged thereon. Viewed in the axial direction, the connecting housing 25 is penetrated by a first recess 27, as well as by a second recess 28, which is designed with a set off diameter in respect to it. In the axial direction, the second recess 28 is bordered by a ring-shaped stop 28' and is connected via an opening 28" with the first recess 27. The first recess 27 has a cylindrical partial element 27', a partial element 27" embodied as an interior thread, and an adjoining annular conduit 26, which is bordered by an interior wall 26". In the assembled state (FIG. 2), the annular conduit 26 is used as a pressure chamber and is connected via a bore 26', which at least penetrates the first cylindrical partial element 25' in the radial direction, with the air injection device 47 (FIG. 1). Furthermore, a groove 24 for the seal 5 (FIG. 5), which encircles the bore 26', is provided on the exterior of the first cylindrical partial element 25'.

The insertion element 30 has a first cylindrical partial element 31 provided with an annular groove 31" for the seal 2 (FIG. 2), as well as a second partial element 32, whose diameter is embodied set off in respect to the first and which is provided with an annular groove 32" for the seal 3 (FIG. 2). A third partial element 33, which is embodied conically tapering, is formed on the front end of the second partial element 32. Viewed in the axial direction, the insertion element 30 is penetrated by a first bore 31', a second bore 32' embodied set off in respect to the first and by an adjoining recess 34', which is embodied conically tapering in the direction toward the outlet opening 34.

The guide sleeve 35 has a hollow-cylindrical body 37, which is provided on one end with a flange 36 and on the other, opposite end with a hub element 36' arranged in the interior chamber of the body 37. The hollow-cylindrical body 37 is penetrated by a first recess 37' oriented in the axial direction. The hub element 36' has a centering element 38 arranged coaxially in it which, for guiding the piston rod 43 (FIG. 2), is penetrated by a second recess 38', which is in connection with the first recess 37' of the hollow-cylindrical body 37. The hub element 36' is penetrated by several bores 38", which are arranged distributed in the circumferential direction and through which the adhesive, which is under pressure, is delivered to the insertion element 30.

Figure 4:
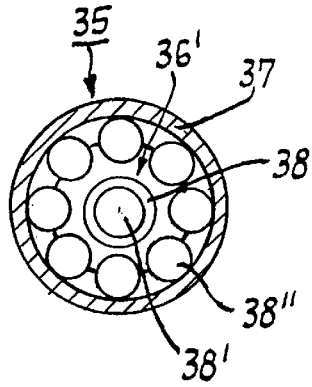
FIG. 4 represents a section along the line IV—IV through a guide sleeve of the spray head in accordance with FIG. 2.

FIG. 4 shows a section along the line IV—IV through the guide sleeve 35, and the hollow-cylindrical body 37, the hub element 36' arranged therein with the centering element 38 and the recess 38' arranged therein, as well as the bores 38", which are arranged, distributed in the circumferential direction in relation to each other, in the hub element 36'.

Figure 5:
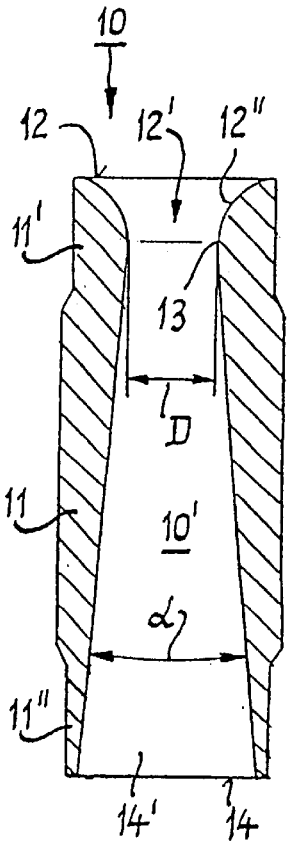
FIG. 5 represents an air nozzle for a nozzle body arranged on the spray head in accordance with FIG. 2, shown on a larger scale and in section.

The air nozzle 10, which can be inserted into single bore 20 of the nozzle body 15 (FIGS. 2, 7), is represented on a larger scale as well as in section in FIG. 5. The air nozzle 10 of the exemplary embodiment represented consists of an elongated, hollow-cylindrical small tube 11, which is respectively provided with a set off collar 11' and collar 11" at the two outer ends. The small tube 11 has an interior chamber 10' oriented in the axial direction which, starting at the inlet side 12, has a convergently designed partial element 12', a nozzle throat 13 adjoining it and a partial element 14' adjoining the latter and divergently oriented in the direction toward the outlet side 14. Starting at the inlet side, the convergent partial element 12' is provided with a circular wall section 12" embodied in the shape of a segment of a circle in the direction toward the nozzle throat 13, which has a constricted diameter. In the preferred exemplary embodiment, the nozzle throat 13 has a diameter D of approximately 0.3 to 0.6 mm, which is adjoined by the divergent partial element 14', which is oriented at an acute angle $\alpha$ in the direction toward the outlet side 14. The angle $\alpha$ of the divergent partial element 14' is approximately 10 in the preferred exemplary embodiment.

In connection with a variation, not represented, of the air nozzle 10 there is the possibility that it only has the partial element 12', which is embodied convergent in the direction of the nozzle throat 13, and is provided, starting at the nozzle throat 13 in the direction of the outlet side 14, with a cylindrically embodied partial element 14'.

Figure 6:
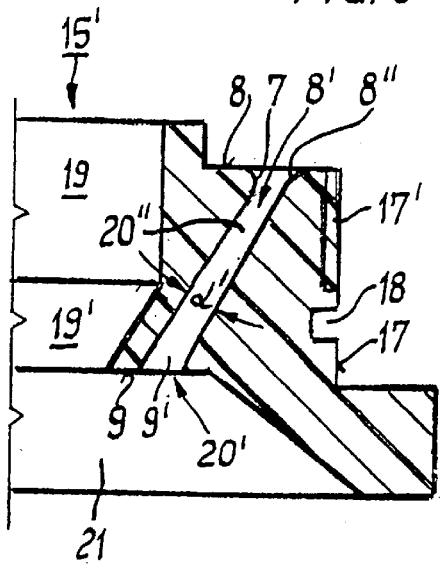
FIG. 6 represents a variation of the nozzle body for the spray head in accordance with FIG. 2 in a sectional view.

FIG. 6 shows as a further exemplary embodiment the nozzle body 15', represented in section and as a partial element, and the two bores 19, 19' and the recess 21, the cylindrical partial element 17 with the groove 18 and the exterior thread 17' are visible. Essentially the nozzle body 15' is embodied analogous to the nozzle body 15, which was described in detail in connection with FIG. 3. Different from this, with the nozzle body 15' in accordance with FIG. 6, the individual bores 20', which are obliquely inclined in the direction of the axis of symmetry S (FIG. 3) are provided with the interior chamber 20", which is designed analogous to the interior chamber 10' of the air nozzle 10 described above in connection with FIG. 5. The interior chamber 20" of the bore 20' has a partial element 8' which, starting from the inlet side 8, is embodied to be convergent, a nozzle throat 7 following it, as well as a partial element 9' adjoining the latter and oriented divergent in the direction of the outlet side 9. Starting at the inlet side 8, the convergent partial element 8' is provided in the direction toward the nozzle throat 7, whose diameter is constricted, with a circular wall section 8" embodied in the shape of a segment of a circle.

The nozzle body 15' represented as a variation in FIG. 6, together with the bores 20' arranged in it and essentially embodied in a nozzle shape, can be made of a suitable plastic material, for example in an injection process, wherein the interior chamber 20" of the bores 20' has a completely smooth interior surface, which is fluidically optimal.

Figure 7:
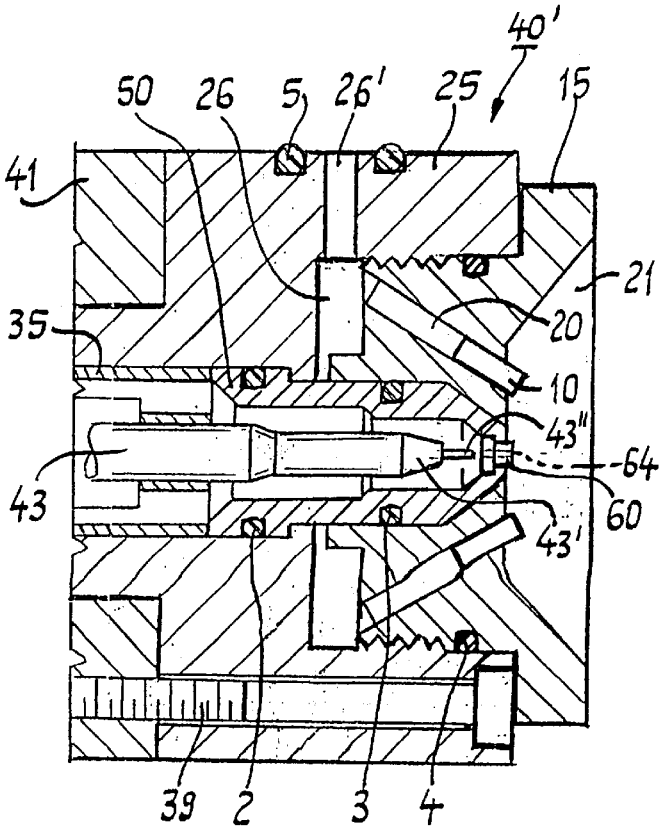
FIG. 7 represents a second exemplary embodiment of the spray head for the installation, shown on a larger scale and partially in section.

The air nozzle 10, which is described above in connection with FIG. 5 and can be inserted into the nozzle body 15 in accordance with FIG. 2 or FIG. 7, or respectively the bores 20" arranged in the nozzle body 15' and having the convergent and divergent partial elements 8', 9', essentially assure the pressure distribution as in a Laval nozzle, known per se. In this connection the air jet, which is expelled from the air nozzle 10 of the nozzle body 15, or respectively from the correspondingly embodied bores 20" of the nozzle body 15', has a defined starting velocity (subsonic speed) in the convergent element 12' or 8', and therefore upstream of the respective nozzle throat 13 or 7 which, during passage through the nozzle throat 13 or 7 is appropriately increased (sonic speed) and is again accelerated in the divergent partial element 14' or 9' (supersonic speed).

FIG. 7 represents the second exemplary embodiment of the spray head 40' for the spray device 45 in accordance with FIG. 1 on an enlarged scale and partially in section, and visible therein are the connecting housing 25, which is fastened on the housing 41 by means of screws 39, as well as the screwed-in nozzle body 15 with the air nozzles 10 arranged therein in the circumferential direction and distributed in relation to each other. Furthermore, a partial element of the guide sleeve 35 with the piston rod 43 seated coaxially therein, as well as an insertion element 50, which is arranged in the nozzle body 15 and held by means of the compression-spring-loaded guide sleeve 35, are also visible.

Different from the spray head 40 in accordance with FIG. 2, with the spray head 40' in accordance with FIG. 7 a mouthpiece 60 embodied in a nozzle-shape is arranged is arranged on the outlet end of the insertion element 50. For the exit of the delivered adhesive (not represented) in the form of the thin stream of spray 6 (FIG. 1), the mouthpiece 60 is provided with an appropriately designed outlet opening 64. In the exemplary embodiment in accordance with FIG. 7, the piston rod 43 on the conically tapered partial element 43' is provided with a tip 43", which can be inserted coaxially into the mouthpiece 60 and is shaped like a needle. Analogous to the description in connection with FIG. 2, the piston rod 43 can be displaced in the arrow direction X or X', depending on how the not represented piston element is being acted upon.

Figure 8:
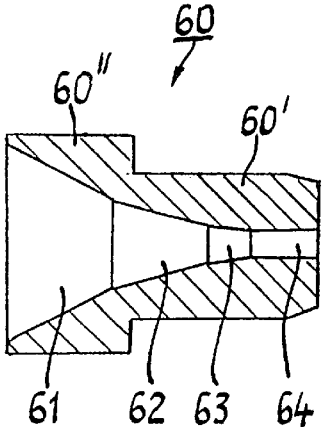
FIG. 8 represents a spray nozzle for an insertion element arranged in the spray head in accordance with FIG. 7, shown on a larger scale and partially in section.

FIG. 8 represents the mouthpiece 60 for the spray head 40', which is embodied in a nozzle shape and is shown on an enlarged scale and in section. The mouthpiece 60 has a first cylindrical partial element 60', as well as a second cylindrical partial element 60", whose diameter is set off. Viewed in the flow-through direction, the mouthpiece 60 is penetrated by several recesses 61, 62, 63, each of which is oriented in a conically tapering manner in the direction toward the outlet opening 64.

The insertion element 50 has a non-identified recess, which is designed to correspond to the exterior shape of the mouthpiece 60, and in which the mouthpiece 60 is arranged, as represented in FIG. 7. The mouthpiece 60 is preferably pressed into the recess of the insertion piece 50.

The piston rod 43 with the conical partial element 43' formed thereon and the tip 43" formed on the latter, as well as the mouthpiece 60 are embodied in such a way that the outlet opening of the latter can be closed by the tip 43". In this case the tip 43" projects slightly (approximately by 0.2 mm) out of the outlet opening 64, so that in this operating position there is no remaining amount of the adhesive left in the outlet opening 64 designed as a nozzle conduit. This design assures that the formation of drops (glue spots), which leads to malfunctioning of the machine, is prevented at the start of the application of glue to the product surface to be sprayed.

What is claimed is:

1. A method for applying an adhesive to a product surface wherein, by means of a spray head provided with a nozzle body, the adhesive is applied to the product surface to be sprayed as a thin stream of spray in the approximate shape of a spiral, on which at least one air jet acts at the outlet, characterized in that for the spiral-shaped delivery, as well as the application to the product surface, the thin stream of adhesive spray (6) exiting the spray head (40, 40') is acted upon by at least one air jet, which has been accelerated by convergent-divergent means of the nozzle body (15, 15').

2. The method in accordance with claim 1, characterized in that the air, which is delivered to the nozzle body (15, 15') at an initial speed, is expelled in the form of an air jet, which has been sped up to sonic speed by means of the convergent-divergent means of the nozzle body (15, 15'), and accelerated to supersonic speed.

3. The method in accordance with claim 2, characterized in that for the purpose of a spiral-shaped application to the product surface, the thin stream of adhesive spray (6), which exits the spray head (40, 40') in approximately a straight line, is acted upon by two or more air jets, which have been accelerated to supersonic speed.

4. The method in accordance with claim 3, characterized in that the thin stream of adhesive spray (6) is acted upon by one or several air jet(s), which has/have been accelerated to supersonic speed by the convergent-divergent means, and is/are directed on the exterior periphery of the spray (6).

5. A device for applying an adhesive in the form of a spiral-shaped thin stream of adhesive spray, having a housing embodied for receiving the adhesive delivered by a piston unit, having a spray head arranged thereon, which is connected with an air injection device and has a nozzle body, which is provided with bores, which are arranged distributed in respect to each other over the circumferential direction and are oriented obliquely in the direction of the exiting thin stream of spray, on which at least one air jet is to act, characterized in that for achieving an air jet, which is expelled in an accelerated manner and is directed onto the thin stream of adhesive spray (6), an air nozzle (10) with an interior chamber (10'), which is embodied convergent-divergent in the flow-through direction, can be respectively inserted into the bores (20, 20'), which can be charged with air via an associated air conduit (26), or that the interior chamber (20"), which is oriented in the flow-through direction, of the single bore (20') is embodied to be convergent-divergent.

6. The device in accordance with claim 5, characterized in that the bores (20'), which are arranged in the nozzle body (15') and penetrate it, respectively have an interior chamber (20'), which extends over their entire length and is embodied to be convergent-divergent.

7. The device in accordance with claim 6, characterized in that at a distance from the air inlet side (8), the interior chamber (20") is provided with a nozzle throat (7), which constricts the interior chamber (20") and, following this, with a partial element (9'), which is divergent at an acute angle ($\alpha$) in the direction toward the outlet side (9).

8. The device in accordance with claim 7, characterized in that starting at the air inlet side (8), the convergently embodied partial element (8') of the bore (20') is provided in the direction toward the nozzle throat (7) with a wall section (8"), which is embodied in the shape of a segment of an arc.

9. The device in accordance with claim 8, wherein the nozzle body (15"), together with the bore (20") arranged therein and respectively having a convergent-divergent interior chamber (20"), is made of a plastic material.

10. The device in accordance with claim 6, characterized in that the nozzle body (15"), together with the bores (20') arranged therein and respectively having a convergent-divergent interior chamber (20"), is made of a suitable plastic material.

11. The device in accordance with claim 7, wherein the nozzle body (15"), together with the bore (20") arranged therein and respectively having a convergent-divergent interior chamber (20"), is made of a plastic material.

12. The device in accordance with claim 5, characterized by a connecting housing (25) for receiving an insertion element (30, 50), provided with an outlet opening (34, 64) embodied as a nozzle conduit for the thin stream of adhesive spray (6), a guide sleeve (35), embodied for the coaxial seating of the piston rod (43), and the nozzle body (15, 15'), which is provided either with the air nozzles (10), which are distributed in the circumferential direction and respectively have a convergent-divergent interior chamber (10'), or with bores (20'), which are distributed in the circumferential direction and respectively have a convergent-divergent interior chamber (20").

13. The device in accordance with claim 12, characterized in that with a cylindrical, as well as conically tapering partial element (32, 33) formed on it, the insertion element (30, 50) is arranged in analogously designed bores (19, 19') of the nozzle body (15, 15'), and is arranged and held, coaxially centered, in the nozzle body (15, 15') by means of the restoring force of a spring element (44) acting on the guide sleeve (35).

14. The device in accordance with claim 13, characterized in that a mouthpiece (60), which is provided with the outlet opening (64), is arranged in the insertion element (50) and has conically tapering recesses (61, 62, 63) arranged in sequence in the flow-through direction, for inserting the piston rod (43), which is provided at the front end with a needle-shaped tip (43").

15. The device in accordance with claim 14, characterized in that the tip (43"), which is arranged on the conical partial element (43') of the piston rod (43) and can be inserted into the outlet opening (64) of the mouthpiece (60) for closing it, is designed in such a way that in the inserted state the tip slightly projects out of the outlet opening (64) of the mouthpiece (60).

16. The device in accordance with claim 15, characterized in that the mouthpiece (60), which is provided with the outlet opening (64), is made of a suitable plastic material and pressed into the insertion element (50).

17. The device in accordance with claim 13, characterized in that for inserting the piston rod (43), which is provided with a conically tapering partial element (43') at the front end, the insertion element (30) has a recess (34'), which is embodied to be conically tapering and is connected with the outlet opening (34).

18. The device in accordance with claim 12, characterized in that the nozzle body (15, 15'), which is provided with an exterior thread (17"), can be screwed into a recess (27), which is provided in the connecting housing (25) and is provided with an interior thread (27") in such a way, that an annular conduit (26), which is embodied as a pressure chamber, is arranged between the rear (22') of the nozzle body and the interior wall (26") of the connecting housing (25) and is connected with a bore (26"), which penetrates the cylindrical partial element (25') of the connecting housing (25) and delivers compressed air.

19. The device in accordance with claim 12, characterized in that the nozzle body (15, 15') arranged in the connecting housing (25) can be adjusted in the axial direction relative to the outlet opening (34, 64) of the insertion element (30, 50).

20. The device in accordance with claim 5, characterized in that the single air nozzle (10) consists of a hollow-cylindrical small tube, whose interior chamber (10') has, at a distance from the air inlet side (12), a nozzle throat (13), which constricts the interior chamber (10') and, following this, a partial element (14'), which is divergently embodied at an acute angle ($\alpha$) in the direction toward the outlet side (14).

21. The device in accordance with claim 20, wherein the interior chamber (10') of the air nozzle (10) is provided with a partial element (12'), which is embodied convergent in the direction of the air inlet side (12), and comprises a wall section (12"), which is oriented in a direction toward the nozzle throat (13) in the shape of a segment of a circle.

22. The device in accordance with claim 21, wherein the air nozzle (10), respectively arranged in the bore (20) of the nozzle body (15), is arranged axially adjustable in the bore (20) in relation to a thin stream of adhesive spray (6) coming out of the outlet opening (34) of the insertion element (30).

23. The device in accordance with claim 20, wherein the air nozzle (10), respectively arranged in the bore (20) of the nozzle body (15), is arranged axially adjustable in the bore (20) in relation to a thin stream of adhesive spray (6) coming out of the outlet opening (34) of the insertion element (30).

24. The device in accordance with claim 5, characterized in that the interior chamber (10') of the air nozzle (10) is provided with a partial element (12'), which is embodied convergent in the direction of the air inlet side (12), which is designed as a wall section (12"), which is oriented in the direction toward the nozzle throat (13) and is designed in the shape of a segment of a circle.

25. The device in accordance with claim 24, wherein the air nozzle (10), respectively arranged in the bore (20) of the nozzle body (15), is arranged axially adjustable in the bore (20) in relation to a thin stream of adhesive spray (6) coming out of the outlet opening (34) of the insertion element (30).

26. The device in accordance with claim 5, characterized in that the air nozzle (10), respectively arranged in the bore (20) of the nozzle body (15), is arranged axially adjustable in the bore (20) in relation to the thin stream of adhesive spray (6) coming out of the outlet opening (34) of the insertion element (30).

* * * * *